United States Patent [19]

Fuller

[11] 4,351,136

[45] Sep. 28, 1982

[54] GROUND ANCHOR INSTALLATION

[75] Inventor: Francis M. Fuller, Houston, Tex.

[73] Assignee: Raymond International Builders, Inc., Houston, Tex.

[21] Appl. No.: 111,547

[22] Filed: Jan. 14, 1980

[51] Int. Cl.[3] ..... E02D 5/76

[52] U.S. Cl. ..... 52/155

[58] Field of Search ..... 52/155, 156, 158, 162–165, 52/295, 296, 230; 405/237, 239, 238

[56] References Cited

U.S. PATENT DOCUMENTS

| | | | |
|---|---|---|---|
| 756,640 | 4/1904 | Irons | 52/162 |
| 890,765 | 6/1908 | Gilbreth | 405/237 |
| 945,269 | 1/1910 | Fuchs | 52/164 |
| 1,081,654 | 12/1913 | Beck . | |
| 1,273,890 | 7/1918 | Loseth | 52/162 |
| 1,844,273 | 2/1932 | Colvin | 52/162 |
| 1,982,963 | 12/1934 | Post | 52/162 |
| 2,150,358 | 3/1939 | Brakensiek | 52/162 |
| 3,012,644 | 12/1961 | Bush . | |
| 3,115,226 | 12/1963 | Thompson . | |
| 3,250,075 | 5/1966 | Webb | 52/166 |
| 3,824,748 | 7/1974 | Pichowicz . | |
| 3,935,912 | 2/1976 | Shibata | 52/163 |
| 4,060,994 | 12/1977 | Chitis | 405/244 |

FOREIGN PATENT DOCUMENTS

| | | | |
|---|---|---|---|
| 432830 | 11/1889 | Fed. Rep. of Germany | 52/162 |
| 600254 | 3/1978 | U.S.S.R. | 52/295 |

*Primary Examiner*—John E. Murtagh

*Attorney, Agent, or Firm*—Fitzpatrick, Cella, Harper & Scinto

[57] ABSTRACT

A ground anchor for resisting uplift loads is installed by forming a hole in the earth with an enlargement at the bottom, placing an anchor plate in the bottom of the hole with projectable toggle arms extending out into the hole enlargement and with at least one tension member extending up through the hole from the anchor plate and pouring concrete into the hole to fill at least the enlargement. The toggle arms effectively increase the size of the anchor plate and the effective size of the concrete enlargement so that a larger cone of earth above the anchor plate is utilized for uplift load resistance.

19 Claims, 14 Drawing Figures

10
12
14
16
18
20
22
24
26
38
38a
38b
5

GROUND ANCHOR INSTALLATION

BACKGROUND OF THE INVENTION

1. Field of the Invention

This invention relates to ground anchor installations for resisting uplift loads. These ground anchors may be used, for example, to resist test loads which are applied to piles which have been driven into the ground near the ground anchors.

2. Description of the Prior Art

The following United States patents show ground anchors for resisting uplift loads: U.S. Pat. No. 1,081,654, U.S. Pat. No. 1,982,963, U.S. Pat. No. 3,012,644, U.S. Pat. No. 3,115,226 and U.S. Pat. No. 3,824,748. Each of these patents shows an elongated tension member which is either driven into the earth or is lowered down through a predrilled hole in the earth. The lower end of the tension member is provided with hinged flutes or arms which lie flat against the tension member to minimize resistance as it is lowered or driven into the earth. When an uplift load is applied to the tension member the flutes or arms pivot to flare out from the tension member and dig into the surrounding earth. In this manner uplift resistance is developed in the soil at the base of the tension member. U.S. Pat. No. 3,115,226 shows, in one embodiment, an alternate arrangement wherein the lower end of the tension member is formed to an undulated configuration and is positioned in an enlargement which is filled with concrete.

The uplift resistance capability of ground anchors corresponds to the weight of an inverted cone of earth extending up from the lower end of the anchor to the earth's surface and to the internal shear strength of the soil applied along the plane surface of this cone. It will be seen from this that the uplift resistance increases with greater ground anchor depths since greater anchor depths provide earth cones of greater size, weight and surface area. Another way in which uplift resistance can be increased without increasing the depth of the anchor is to provide a large diameter anchor base. This also provides a larger, though truncated, earth cone with increased weight and lateral surface area. The enlarged concrete base shown as one of the examples in U.S. Pat. No. 3,155,226 utilizes this principle.

It has been found that when an enlarged concrete base or bell is employed at the bottom of a cast-in-place concrete anchor caisson, the full lateral extent of the base cannot be counted on to establish the lower diameter of the truncated earth cone which provides the uplift resistance. This is because the concrete base, which is poured down into the enlarged bottom of the anchor hole alongside the tension member, is unreinforced; and an upwardly flaring shear plane projects through the concrete base or bell from the lower end of the tension member to the upper surface of the enlarged base. The effective lateral diameter of the concrete base therefore is the diameter of the base where that shear plane intersects the upper surface of the bell.

There is frequently a need, such as when testing piles in compression using uplift piles or caissons as a reaction, to establish uplift resistance entirely at some depth below the test pile, so as not to influence the test results. To develop this uplift resistance by friction alone would require exceedingly long piles or drilled shafts. Although one may employ a bell bottom drilled shaft so as principally to utilize the weight of the soil above the bell, unless the bell is reinforced one encounters the problems described above.

SUMMARY OF THE INVENTION

The present invention makes it possible to install ground anchors which, for a given size bell and depth and for a given difficulty of installation, provide a greater degree of uplift load resistance than can be obtained with prior art ground anchors.

According to the present invention there is provided an uplift ground anchor comprising an anchor plate positioned at the bottom of a hole in the earth with one or more tension rods attached to the anchor plate and extending therefrom up through the hole to the ground surface. The hole is enlarged at the bottom where the anchor plate rests and a plurality of arms extend radially outwardly from the anchor plate toward the outer diameter of the enlarged portion of the hole. A concrete base is formed in at least the enlarged portion of the hole over the anchor plate and the radially extending arms; and the tension rod or rods extend up through the concrete base.

With the above described construction, tension loads applied to the tension rods will be transmitted by the rods down to the anchor plate and the radially extending arms or toggles and from there through the enlarged concrete base or bell to the overlying earth. The radially extending arms or toggles effectively enlarge the diameter of the anchor plate so that the overlying cone of earth which provides uplift load resistance is likewise enlarged.

There has thus been outlined rather broadly the more important features of the invention in order that the detailed description thereof that follows may be better understood, and in order that the present contribution to the art may be better appreciated. There are, of course, additional features of the invention that will be described more fully hereinafter. Those skilled in the art will appreciate that the conception on which this disclosure is based may readily be utilized as the basis for the designing of other arrangements for carrying out the several purposes of the invention. It is important, therefore, that this disclosure be regarded as including such equivalent arrangements as do not depart from the spirit and scope of the invention.

BRIEF DESCRIPTION OF THE DRAWINGS

A preferred embodiment of the invention has been chosen for purposes of illustration and description, and is shown in the accompanying drawings, forming a part of the specification, wherein.

The embodiments shown herein have not been built or tested but are proposed.

DETAILED DESCRIPTION OF THE PREFERRED EMBODIMENTS

Figure 1:
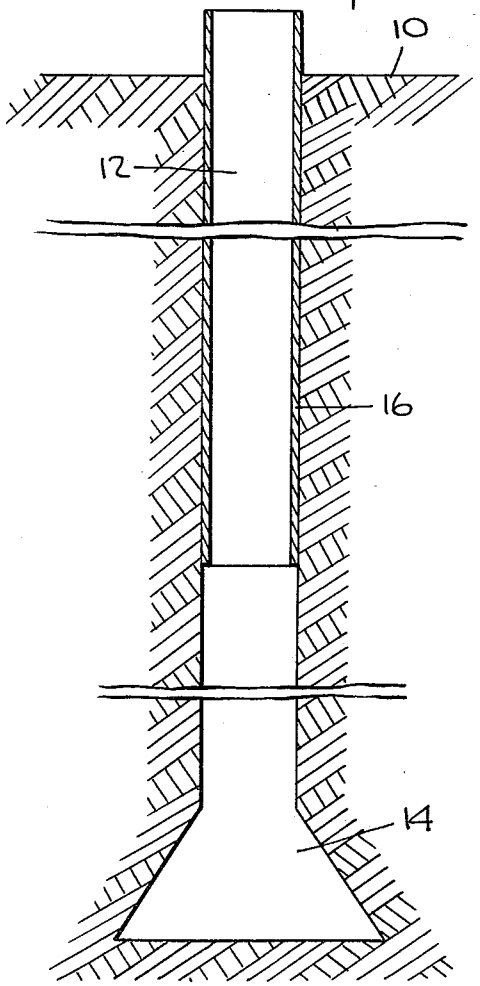
FIG. 1 is an elevational section view, partially cut away, showing a hole formed in the earth for installation of a ground anchor according to the present invention.

As shown in FIG. 1 a situs of earth 10 is prepared for the installation of a ground anchor by forming an elongated hole 12 of substantially uniform diameter to extend down to a predetermined depth. The bottom of the hole 12 is belled or is formed with an enlargement or bell 14. The hole 12 and the enlargement or bell 14 may be formed by means well known in the art such as drilling or jetting tools. If the earth 10 is soft and likely to flow back into the hole 12, the hole may be reinforced by means of a tubular casing 16 which extends part way or entirely down to the enlargement or bell 14 and retains the sides of the hole.

Figure 2:
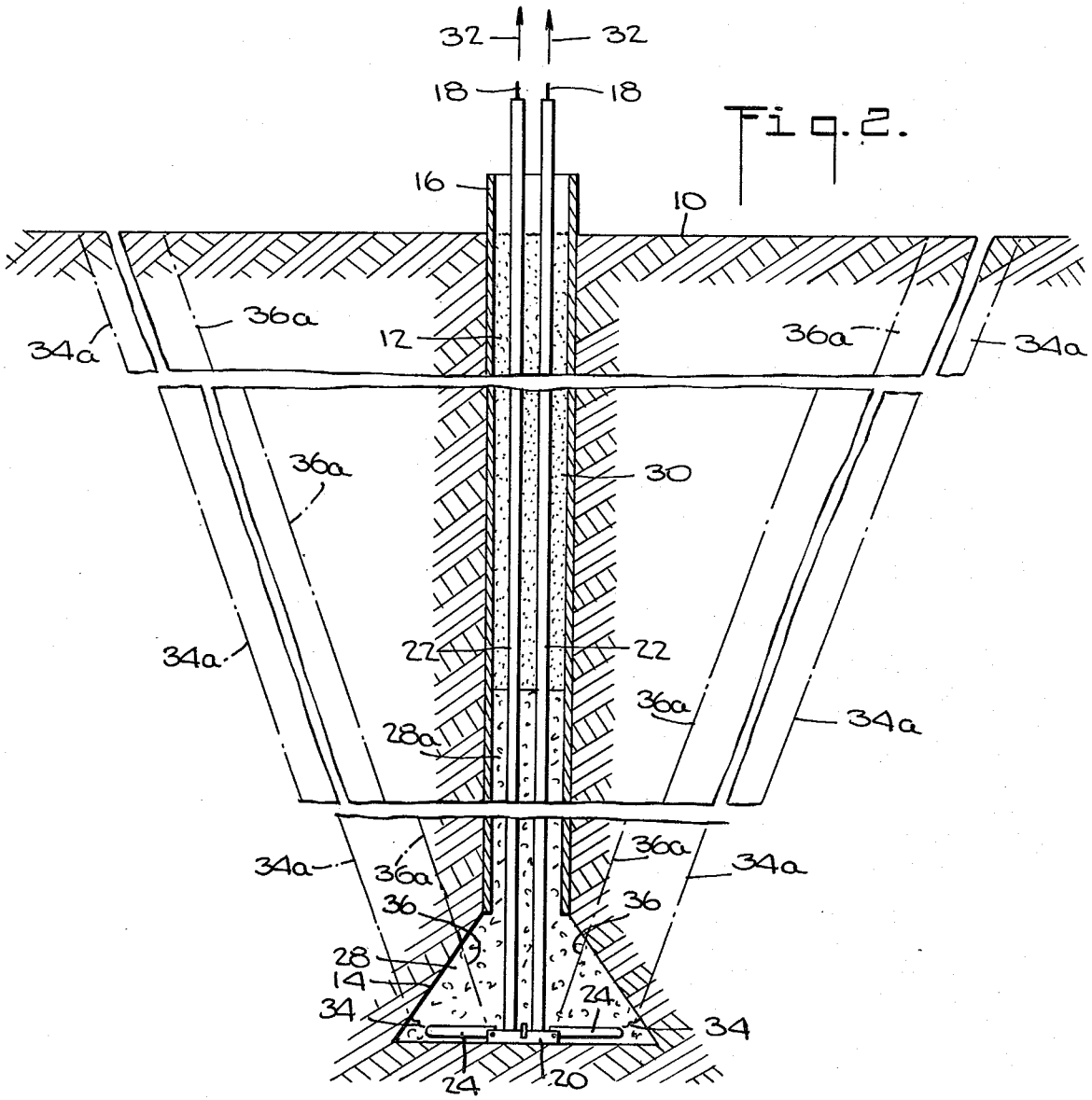
FIG. 2 is an elevational section view, partially cut away and foreshortened, showing a ground anchor according to the present invention installed in the hole of FIG. 1.

The ground anchor of the present invention is installed in the hole 12. As shown in FIG. 2 this ground anchor comprises a plurality of elongated tension rods, bars or straps 18 which extend parallel to each other down through the hole 12 to the bottom of the enlargement or bell 14. An anchor plate 20, which may comprise a disk of steel, lays in the bottom of the enlargement 14 and the tension members 18 in this embodiment are attached to the anchor plate 20 by suitable means, for example, by threaded engagement or by welding. The tension members may pass down through tension rod tubes 22 which also extend down through the hole 12 to the plate 20.

The anchor plate 20, it will be noted, should be as large in diameter or diagonal dimension as practical, and preferably it will be slightly smaller than the diameter of the hole 12 so that the plate can fit down through the hole.

A plurality of radially extending toggle arms 24 are connected by pivots 26 to the anchor plate 20 to extend radially or laterally therefrom toward the outer extremities of the enlargement or bell 14.

A concrete base 28 is poured down over the anchor plate 20 and the arms 24 and around the tension members 18 or tubes 22. In some cases the tubes 22 may not be used and the concrete is thus in direct contact with the tension members 18. The concrete base 28 fills the enlargement or bell 14 and an upper extension 28*a* of the base 28 may extend part way or all the way up through the hole 12. In cases where the extension 28*a* does not extend to the top of the hole 12 the region above the extension may be left empty or filled with sand, gravel, earth, slurry or other suitable material as indicated at 30. Just prior to pouring the concrete, the anchor plate 20 and toggle arms 24 may be lifted or raised a sufficient distance to permit the concrete to flow underneath the anchor plate and the arms. Besides providing a more unified structure, this technique ensures that the anchor plate and arms are protected from corrosion by the covering of concrete.

In use of the above described anchor assembly, an uplift load is applied to the tension members 18 as indicated schematically by the arrows 32. As mentioned previously this uplift load may be produced by pile testing equipment or it may be produced by any other structure which is subject to upward forces in the vicinity of the tension members 18.

The tension members 18, when fully sleeved by the tubes 22, transmit the full uplift forces to the anchor plate 20. These forces are also transmitted from the plate 20 to the toggle arms 24 and from both the plate and the arms to the concrete base 28. The tubes 22 serve to prevent the concrete of the base 28 and its extension 28*a* from engaging into gripping contact with the members 18. Thus the base and its extension are isolated from direct application of tensile forces resulting from bond between the members 18 and the concrete. Instead the tensile forces from the members 18 are applied to the base 28 only via the plate 20 and the toggle arms 24 so that the concrete base is subjected primarily to compressive forces. A conical shear plane does flare out from the outer tips of the radial toggle arms 24 as indicated by an outer shear line 34; and this shear plane extends, conically, up through the surrounding earth as indicated by an outer shear line extension 34*a*.

Figures 3, 4, 5:
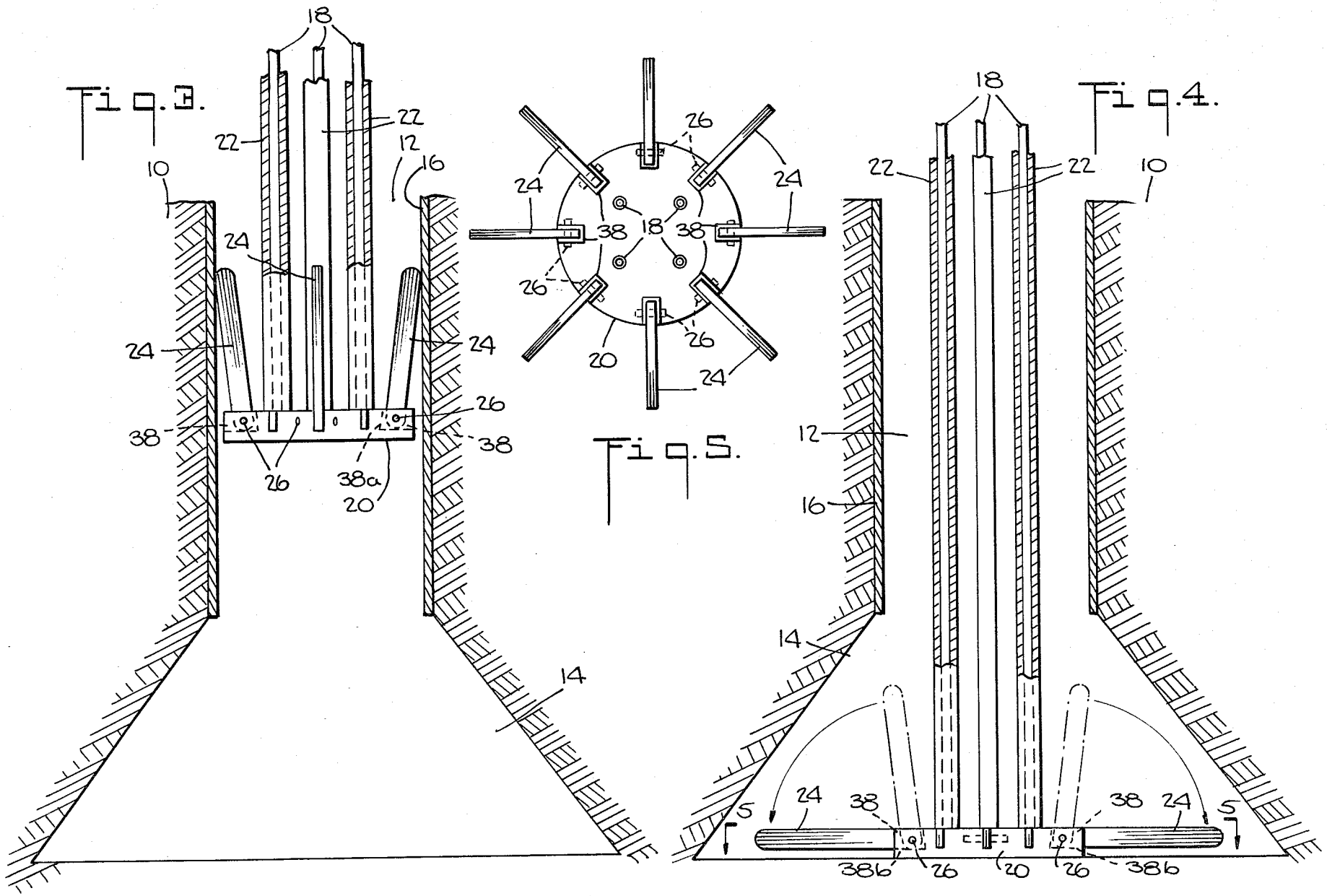
FIG. 3 is an enlarged fragmentary section view of the lower portion of a hole and a portion of the ground anchor in FIG. 2 during an intermediate step in the formation of the ground anchor.
FIG. 4 is a view similar to FIG. 3 but showing a subsequent step in the formation of the ground anchor of FIG. 2.
FIG. 5 is a section view taken along line 5—5 of FIG. 4.

The effectiveness of this invention in providing increased uplift load resistance can be appreciated by considering the situation without the presence of the radial arms 24. In such case a conical shear plane would flare out from the periphery of the anchor plate 20 through the concrete base 28 as illustrated by an inner shear line 36. This shear plane would then extend conically up through the surrounding earth as indicated by an inner shear line extension 36*a*. It can readily be seen that for a given depth and diameter of the hole 12, the anchor arrangement of the present invention forms a cone of greater size and weight and larger surface area than is formed with a prior art anchor arrangement. FIGS. 3–5 illustrate the preferred construction of the anchor plate 20 and radial toggle arms 24 and the manner in which they are installed. As can be seen in these drawings, radial grooves or slots 38 are cut into the plate 20 from its edge and these grooves or slots extend sufficiently towards the center of the plate to accommodate the toggle arms 24. The pivots 26 are pins which are mounted in the plate to traverse the grooves or slots 38. One end of each toggle arms 24 extends into an associated groove or slot 38 and the pin 26 passes through the toggle arm thereby fastening it to the plate 20 in a manner which permits the arm or toggle to pivot from an upwardly extending position as shown in FIG. 3 to outwardly extending position as shown in FIG. 5. In the embodiment of FIGS. 1–5 the grooves or slots 38 each have a back wall 38*a* which limits the upward movement of the toggle arms 24 to a position such that when in their upward position they flare outwardly by a slight amount as shown in FIG. 3. This permits the toggle arms 24 to fit within the hole 12 or the casing 16 when they are pivoted to their upward position and yet it ensures that when the anchor plate 20 reaches the enlargement or bell 14 the toggle arms 24 will fall by gravity to their outwardly extending position as shown in FIG. 4. The grooves or slots 38 may not extend entirely through the thickness of the plate 28 and in such case each groove has a floor 38*b* which, as shown in FIG. 4, limits the downward movement of the arms or toggles 24 to a position where they extend radially outward with their tips near the periphery of the enlargement or bell 14. The length of the toggle arms 24, as can be seen in FIG. 4, may be related to the height of the bell, the slope of its roof, the inside diameter of the hole and the diametrical distance between the pivots of opposing toggle arms. The toggle arms should extend as far as possible in their horizontal (solid line) position and yet they must be short enough to fit inside the hole 12 and swing down from their upward (phantom line) position. The permissible slope of the bell roof is also dependent upon soil conditions. The bell roof is generally sloped from about forty five to sixty degrees from horizontal; and in such case the maximum length of the toggle arms ranges generally from 0.7 to 0.5 times the height of the bell.

As can be seen in FIG. 5 the toggle arms 24, when extended, project in radial array from the anchor plate 20 to increase its effective diameter. Since each toggle arm individually transmits forces to the concrete base 28 shear planes will be formed in the base extending up from the outer tips as well as the tops of the toggle arms. By providing several toggle arms, the shear planes will merge and thereby the group of toggle arms will effectively act as a single plate of large diameter. The flare angles of the shear planes extending up from the toggle arms 24 depend upon the material of the base 28 and this in turn will establish the number of toggle arms required for a particular installation.

FIGS. 6–13 show alternative arrangements for mounting the toggle arms 24 so that they may extend upwardly to fit in the hole 12 or casing 16 as the plate 20 is lowered and then automatically pivot outwardly to a horizontal position when the plate is lowered down to the enlargement or bell 14.

Figure 6:
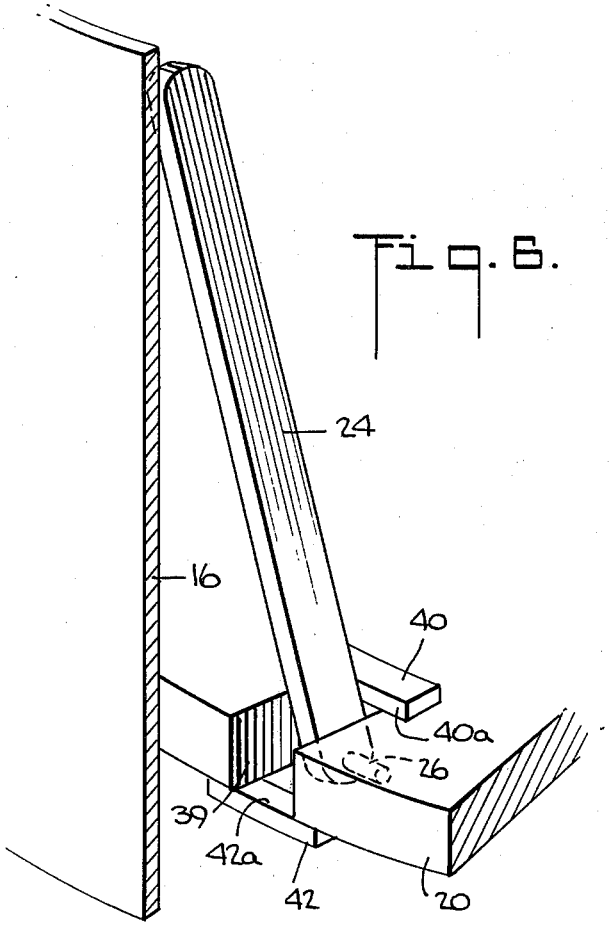
FIG. 6 is a fragmentary perspective view showing an alternate plate and toggle arm arrangement used to form the ground anchor of FIG. 2.
Figure 7:
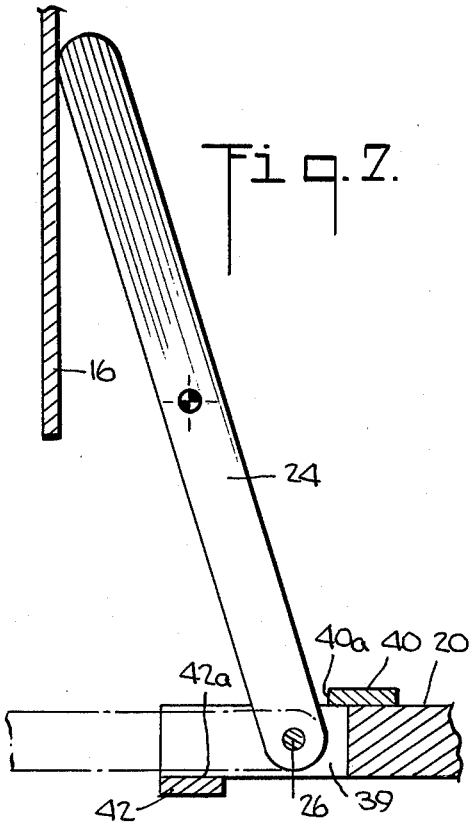
FIG. 7 is a side elevational view of the plate and toggle arm arrangement of FIG. 6.

As shown in FIGS. 6 and 7 slots 39 are provided at the edge of the plate 20 and these slots extend through the entire thickness of the plate. Upper and lower stops 40 and 42 lie along the upper and lower surfaces, respectively, of the plate 20 and extend across the slots 39. The upper stop 40 provides a front surface 40*a* which prevents the toggle arm 24 from extending vertically but which instead ensures that it extends at a slant and leans outwardly against the casing 16. As can be seen in FIG. 7, the center of gravity of the toggle arm 24 is thus always maintained outwardly of the pivot 26 so that when the toggle arm 24 passes below the casing and into the enlargement or bell 14 the weight of the toggle arm will pull it from its upwardly extending (solid line) position to its horizontally extending (phantom line) position. The lower stop 42 provides an upper surface 42*a* which maintains the position of the horizontally extending toggle arm in the enlargement or bell 14. The stops 40 and 42 may be secured to the plate 20 in any suitable manner, for example, by welding.

Figure 8:
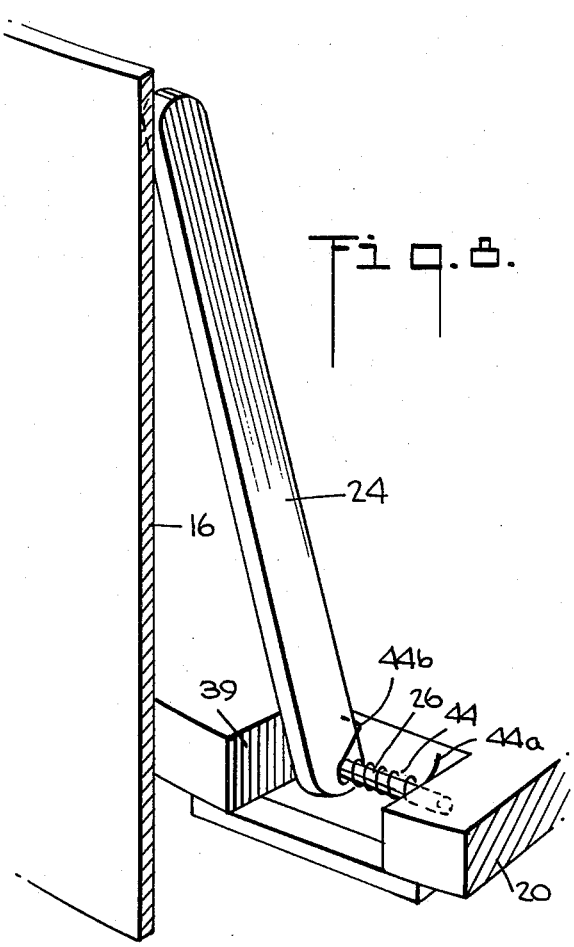
FIG. 8 is a view similar to FIG. 6 but showing a resilient biasing means used with the plate and toggle arm arrangement.
Figure 9:
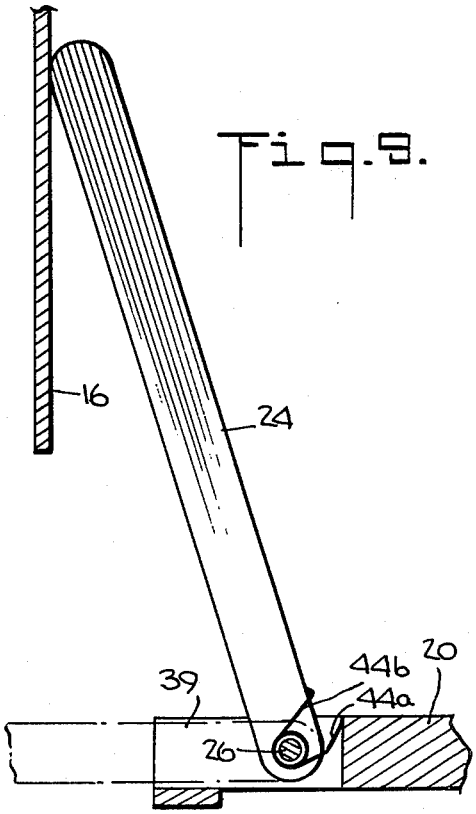
FIG. 9 is a side elevational view of the plate and toggle arm arrangement of FIG. 8.

In FIGS. 8 and 9 an alternate mounting for the toggle arms 24 is shown. This mounting includes a torsion spring 44 which extends around the pivot 26 and the opposite ends of the spring, 44*a* and 44*b* engage the plate 20 and the toggle arm 24 respectively. The spring 44 is thus biased to urge the toggle arm 24 toward its horizontal position while allowing the toggle arm to be pushed to its upwardly extending position.

Figure 10:
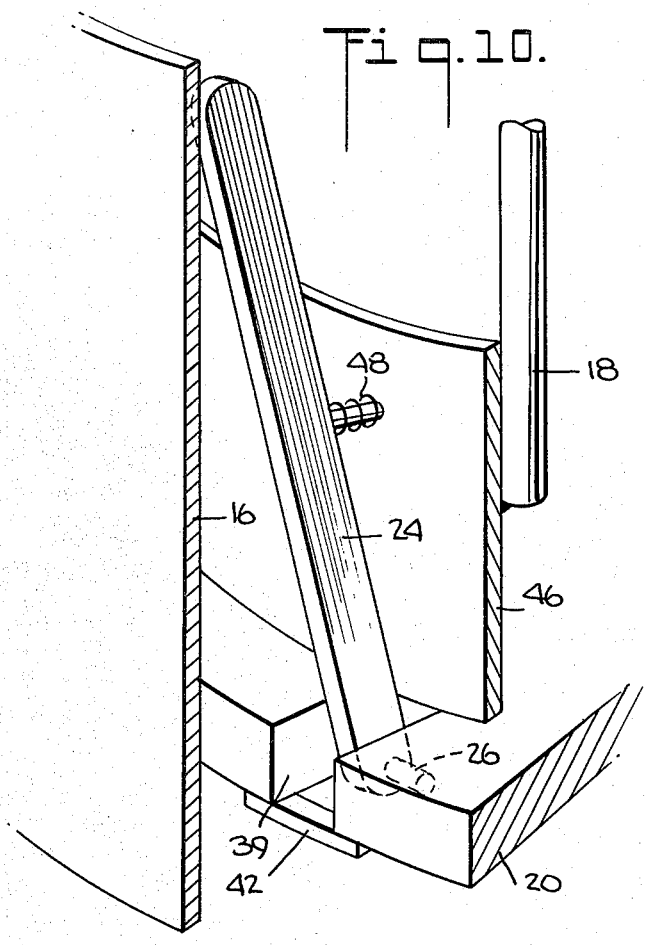
FIG. 10 is a view similar to FIG. 8 but showing a different resilient biasing means.
Figure 11:
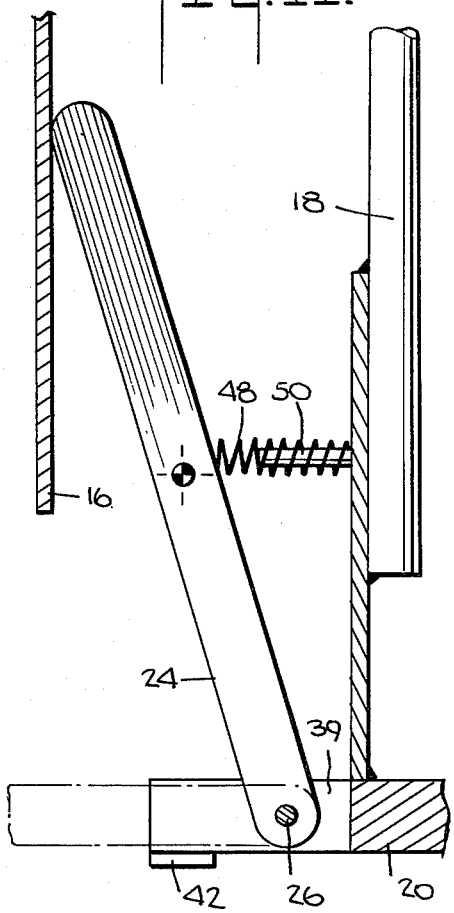
FIG. 11 is a side elevational view showing the plate and toggle arm arrangement of FIG. 10.
Figure 12:
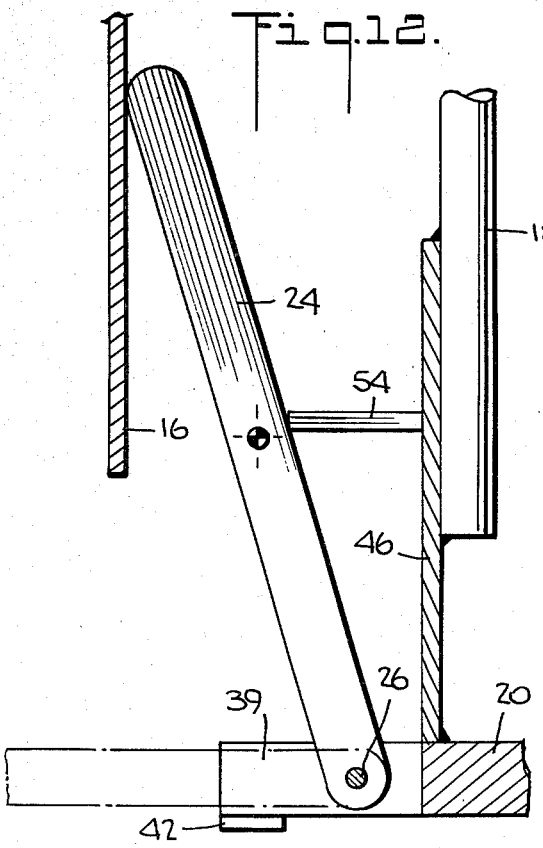
FIG. 12 is a view similar to FIG. 7 but showing an alternate toggle arm abutment arrangement.

FIGS. 10 and 11 show another resilient biasing arrangement for the toggle arm 24. The embodiment of FIGS. 10 and 11 also show an alternative arrangement for attaching the tension members 18 to the plate 20. As can be seen in FIGS. 10 and 11 a short sleeve 46 is attached to the upper surface of the plate 20 for example, by welding. The tension members 18 extend down inside the tubular member 46 and are attached to the sleeve for example also by welding. A compression spring 48 extends outwardly from the outer surface of the tubular member 46 above each slot 39 toward one of the toggles 24. The spring 48 may be supported on a rod-like support 50 which projects out from the tubular member 46. As can be seen in FIG. 11 the spring 48 presses outwardly against the toggle arm 24 when the plate 20 is being lowered through the casing 16 and causes the toggle to press against the casing. When the toggle arm has been lowered below the casing and into the enlargment or bell 14 the spring 48 will move the toggle arm 24 outwardly by an amount such that the center of gravity of the toggle arm is well outward of its pivot 26 to ensure that the toggle arm will fall to its horizontal position by its own weight. FIG. 12 shows an arrangement similar to FIGS. 10 and 11 except that in FIG. 12 no spring is provided. Instead there is provided an abutment 54 aligned with each toggle arm 24 and of sufficient length to maintain the toggle arm extending outwardly enough so that its center of gravity always remains outside the pivot 26. Thus when the plate 20 and toggle arms are lowered into the enlargement or bell 14 the toggle arms will be pulled by gravity to their horizontal positions.

Figure 13:
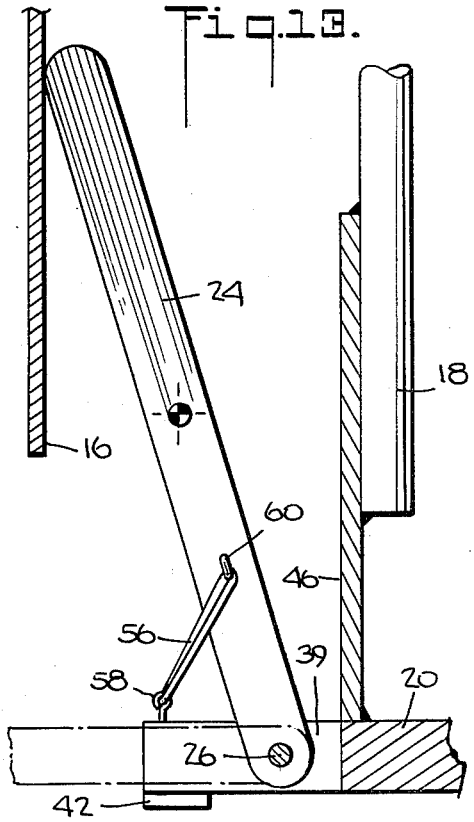
FIG. 13 is a view similar to FIG. 11 but showing a still further resilient biasing means.

FIG. 13 shows a still further resilient biasing arrangement for the toggle arm 24. As shown in FIG. 13 a tension element, such as an elastic band 56, or spring, is stretched between a plate anchor 58 located near the edge of the plate 20 and a toggle anchor 60 located on the toggle arm 24. When the toggle arm 24 is in its upwardly extending position as shown in FIG. 13, the elastic band 56 pulls it out against the casing 16. When the plate 20 and toggle arms are lowered below the casing 16 and into the enlargment or bell 14 the elastic bands 56 pull the toggle arms outwardly by an amount sufficient to ensure that their centers of gravity are well beyond their pivots 26 whereupon gravity will pull the toggle arms to their horizontally extending position.

Having thus described the invention with particular reference to the preferred forms thereof, it will be obvious to those skilled in the art to which the invention pertains, after understanding the invention, that various changes and modifications may be made therein without departing from the spirit and scope of the invention as defined by the claims appended hereto.

What is claimed and desired to be secured by Letters Patent is:

1. A ground anchor for resisting uplift loads, said ground anchor comprising an anchor plate positioned at the bottom of a hole in the earth, said hole having a substantially uniform diameter throughout its length with an enlarged portion of substantially larger diameter at the bottom of the hole, and said plate having a diameter slightly smaller than the diameter of the shaft portion of said hole, a plurality of radially extending arms projecting outwardly from said anchor plate toward the outer periphery of said larger diameter portion of said hole, a concrete base filling at least the enlarged bottom portion of said hole and covering said anchor plate and arms, at least one tension member connected to said anchor plate and extending up through said concrete base and said hole to the surface of the earth, said tension member being insolated from gripping engagement by said base, whereby uplift loads applied to said tension member are transferred therefrom only via said anchor plate and arms to said concrete base to subject said concrete base primarily to compressive forces and to produce a shear plane in said base extending upwardly and outwardly from the outer tips of said arms and continuing up through the overlying earth.

2. A ground anchor according to claim 1 wherein at least a part of said tension member passes through a tube extending up from said anchor plate and wherein said tube passes through the concrete in said base or shaft to isolate the tension member from gripping engagement by said concrete base or shaft.

3. A ground anchor according to claim 1 wherein said arms are pivotally connected to said anchor plate to swing between an upwardly extending position permitting the plate and arms to fit down through said hole, and an outwardly extending position with the tips of the arms located near the outer periphery of said larger diameter portion of said hole.

4. A ground anchor according to claim 3 wherein abutment means are arranged on said anchor plate to ensure that said arms flare outwardly when in their upwardly extending position, so that said arms will pivot by gravity to their outwardly projecting position.

5. A ground anchor according to claim 3 wherein limit means are provided on said anchor plate to limit the downward movement of said arms beyond an outwardly extended radial position.

6. A ground anchor according to claim 4 wherein said arms are fitted into slots formed in the outer edge and upper surface of said anchor plate, the back edge of said slots forming said abutment means to ensure an outward flare of said arms when in their upwardly extended position and the floor of said slots forming limit means limiting downward movement of said arms beyond an outwardly extending radial position.

7. A ground anchor according to claim 4 wherein said plate is formed with slots in its outer edge and extending through the thickness of the plate and pivot pins extending across said slots and pivotally connecting said arms to said plate.

8. A ground anchor according to claim 7 wherein abutments extend across said slots to limit the pivotal movement of said arms.

9. A ground anchor according to claim 8 wherein said abutments extend under each slot to limit the downward movement of said arms beyond an outwardly extended radial position.

10. A ground anchor according to claim 8 wherein said abutments include an upper abutment above each slot to ensure that said arms flare outwardly when in their upwardly extending position so that said arms will pivot by gravity to their outwardly projecting position.

11. A ground anchor according to claim 3 wherein resilient means are provided to bias said arms outwardly at least to a location where the center of gravity of each arm is outside its respective pivot so that, when said arm is brought into said larger diameter portion of said hole, gravity will pull the arm to its radially extending position.

12. A ground anchor according to claim 11 wherein said resilient means comprises torsion springs on means pivotally connecting said arms to said plate and wherein said torsion springs press against said arms and said plate.

13. A ground anchor according to claim 11 wherein said resilient means comprises compression springs extending outwardly above said plate to contact and press outwardly on said arms.

14. A ground anchor according to claim 11 wherein said resilient means comprises a tension element extending between a toggle anchor on said arm and an anchor on said plate located near the edge thereof.

15. A ground anchor according to claim 1 wherein a tubular member is attached to and extends up from said plate and wherein said tension members are attached to said tubular member.

16. A ground anchor according to claim 15 wherein abutment means extend outwardly from said tubular member above said slots and into engagement with said arms in their upwardly extending position to ensure that said arms flare outwardly so that said arms will project by gravity to their outwardly projecting position.

17. A method of installing a ground anchor for resisting uplift loads, said method comprising the steps of:

forming a hole extending down into the earth with an enlarged diameter bottom portion and a smaller diameter shaft portion extending up from the bottom portion, lowering an anchor plate having a diameter slightly smaller than the diameter of the shaft portion of said hole down through the shaft portion to the enlarged bottom portion with at least one tension member connected to the anchor plate and extending from the anchor plate up through the shaft portion, projecting a plurality of arms to extend radially out from said anchor plate to locations near the edge of said bottom portion, thereafter placing concrete in said hole to fill at least said enlarged bottom portion over said anchor plate and said arms, preventing said concrete from engaging into gripping contact with said tension member, and allowing said concrete to harden, whereby uplift loads applied to said tension member are transferred through said member only to said anchor plate and arms and from said anchor plate and arms to subject said concrete base primarily to compressive forces and to produce a shear plane in said concrete extending outwardly and upwardly from the outer tips of said arms and continuing therefrom up through the overlying earth.

18. A method according to claim 16 wherein the step of preventing said concrete from engaging into gripping contact with said tension member is carried out by providing a tubular sleeve around said member and by placing said concrete in said bottom portion and in said hole around said sleeve.

19. A method according to claim 16 wherein, prior to placing said concrete said anchor plate and arms are raised by an amount sufficient to permit said concrete to flow underneath said anchor plate and said arms.

* * * * *

UNITED STATES PATENT AND TRADEMARK OFFICE

CERTIFICATE OF CORRECTION

PATENT NO. : 4,351,136

DATED : September 28, 1982

INVENTOR(S) : Francis M. Fuller

It is certified that error appears in the above-identified patent and that said Letters Patent is hereby corrected as shown below:

Column 6, lines 5 and 9, "sleeve" to read

-- tubular member --.

Signed and Sealed this

*Twenty-second* Day of *March 1983*

[SEAL]

*Attest:*

GERALD J. MOSSINGHOFF

*Attesting Officer*

*Commissioner of Patents and Trademarks*